United States Patent [19]

Behl

[11] 3,964,040

[45] June 15, 1976

[54] CIRCUIT FOR DETECTING BURNED-OUT LAMP FOR A BUOY LAMP CHANGER

[75] Inventor: Ravi Behl, Montreal, Canada

[73] Assignee: Vapor Corporation, Chicago, Ill.

[22] Filed: Oct. 29, 1974

[21] Appl. No.: 518,257

[52] U.S. Cl. ..... 340/251; 315/89; 240/37.1

[51] Int. Cl.[2] ..... G08B 21/00; H05B 39/10

[58] Field of Search ..... 340/25, 29, 251, 331; 315/88, 89, 93; 240/37.1; 331/65; 317/146

[56] References Cited

UNITED STATES PATENTS 2,694,148 11/1954 Hagen ..... 317/146 X

*Primary Examiner*—John W. Caldwell
*Assistant Examiner*—Daniel Meyer
*Attorney, Agent, or Firm*—Francis J. Lidd

[57] ABSTRACT

A lamp out detection circuit is provided for a buoy lamp changer. The circuit includes an modified Hartley transistor oscillator which is tuned to operate at a preselected frequency. A typical lamp flasher applies power to the lamp and the lamp out circuit, simultaneously. If a normal lamp is in operation, a current pulse is inductively coupled to the oscillator in a manner suppressing sustained oscillation. Should the filament of an incircuit lamp fail or become electrically non conductive, the lack of inductive coupling to the oscillator would permit sustained oscillation which results in generation of a pulse signal. Time delay means are provided to ensure that the pulse signal is not intermittent. Further indexing through a time delay is provided to permit the lamp changer to rotate a new lamp into an operating position before further monitoring of faults occurs. Means are provided to prevent rotation of the turret after the last lamp has failed.

11 Claims, 4 Drawing Figures

CIRCUIT FOR DETECTING BURNED-OUT LAMP FOR A BUOY LAMP CHANGER

FIELD OF THE INVENTION

The present invention relates to lamp changes, and more particularly to a lamp out detection circuit for navigational buoys and beacons.

BRIEF DESCRIPTION OF THE PRIOR ART

The circuit, which constitutes the present invention is to be used in navigational lamp changers of prior art design. Typical lamp changers are shown in U.S. Pat. Nos. 3,259,785; 3,146,375; 3,781,853; 3,801,975; 2,054,013. The typical lamp changer includes a turret rotatably mounted on a frame and having circumferentially spaced lamp sockets, each of which is adapted to receive a lamp. At one preselected position of the turret, a lamp is placed into the proper focal plane positioned for illuminating a buoy having the lamp changer. Means are provided to detect whether the lamp in the turret socket at the preselected position is burned out or if no lamp is mounted in that socket. If a fault of this type is detected, the turret is caused to rotate thereby bringing a good lamp into an operating position thus avoiding the malfunctioning of the lighted buoy.

Since the navigational devices for which the lamp changer is intended must operate for long periods without attendance, low battery power consumption is of primary importance, since these units are battery powered. Although prior art lamp changers operate satisfactorily, it would be a step forward to reduce the power consumption of lamp out detection circuits. Even the most efficient prior art circuits require a relatively substantial current drain from batteries.

BRIEF DESCRIPTION OF THE PRESENT INVENTION

The present invention is directed to a novel circuit for lamp out detection in a lamp changing system as described. It is to be emphasized that the mechanical mechanism for achieving lamp change would be used with the circuit of the present invention. Otherwise stated, the present invention is not, per se, directed to the mechanical features of a lamp changer, but rather to the lamp out or burnout detection circuit.

By virtue of the present circuit, a reduced current drain upon batteries may result. This is due to the fact that transistors are biased in a manner reducing current drain. In addition, the present circuit exhibits less sensitivity to lamp current variation. Beacon intensity and required life vary from application to application. In many cases, illumination intensity and light interval between battery and/or lamp service are trade-offs. Also, battery life and charge level results in a substantial variation in lamp current over a life cycle. These variations can combine to produce a lamp current variation as high as 12:1. The unique design of the present circuit has sufficient sensitivity to provide operation in this range, since unlike prior art units, lamp current is not directly introduced into the changer circuitry.

Further, the lamp out detection system of the present invention employs a pulse oscillator that oscillates in response to changes of inductance coupling thereto. The inductance coupling is performed by a transformer which has saturation characteristics that inhibit oscillation over a wide current range without requiring filter networks or voltage regulators utilized in the prior art.

An additional advantage of the present invention over previous detection circuits is improved overall reliability. Relative to the available prior art, the disclosed sensor circuitry employs fewer components having improved reliability to sense lamp failure. In particular, the isolation of the lamp high current circuit from DC connections to sensitive electronic circuits provides relief from switching transients when lamps are indexed or changed. The inductive coupling used in the oscillator circuitry of the invention provides a low impedance path to ground for high frequency transients, such as those induced by atmospheric storms and lightning.

An additional advantage of this invention is the ease of limiting the turret rotation and in some cases the number of new lamps moved into the illuminating position during a prescribed maintenance period. Heretofore the number of lamps available was dependent on turret design and could not easily be changed. Some designs continued to rotate after the last lamp failed, resulting in inefficient use of battery energy. The invention described here allows easy and convenient limitation of turret travel to any given position by placing a capacitor across the lamp terminals of that position. This modification is simple and can be performed in the field.

DETAILED DESCRIPTION OF THE INVENTION

Figure 1:
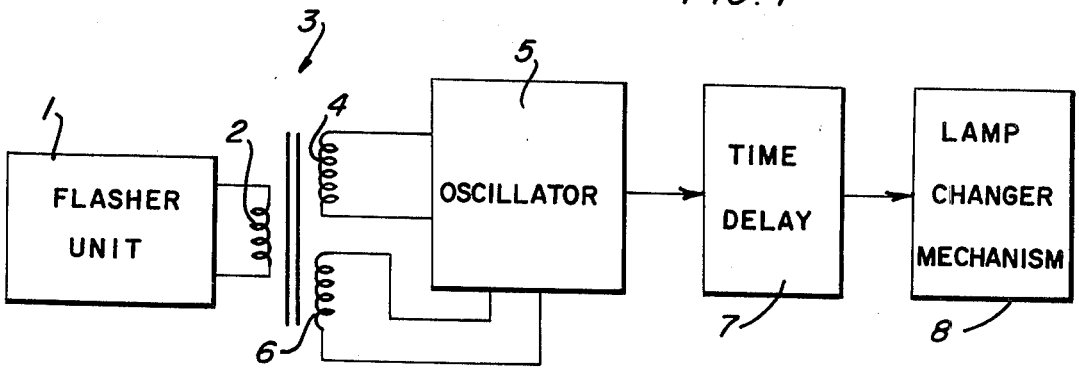
FIG. 1 is a block diagram of the present invention illustrating the primary components thereof.

Referring to the figures and more particularly FIG. 1 thereof, a block diagram of the present invention is illustrated. A flasher unit 1, such as employed in the prior art devices, generates a flashing light during normal operation. The unit 1 is connected to the winding 2 of a transformer, generally indicated by reference numeral 3. The transformer has a second winding 4, connected to the input of an oscillator 5. A third winding 6, of transformer 3 provides feedback to the oscillator input by inducing a current in the second winding 4. If a normal lamp is in operation, a current pulse is drawn through the first winding 2. Simultaneously, a current pulse through the third winding 6 induces an oppositely poled current pulse in the second winding 4, which is swamped out by the larger current from the first winding 2. As a result, no sustained oscillation occurs in the second winding 4. Should the lamp in flasher unit 1 fail, or become electrically non-conductive, and therefore draw insufficient current through the first winding 2, sustained oscillation would result in the second winding 4 which allows a signal to develop at the output of the oscillator 5. A time delay 7 is connected to the output of the oscillator 5 thus preventing the actuation of the lamp changer mechanism 8 by transients. The mechanism 8 will become operative, only after the output from oscillator 5 is sustained for some time.

Figure 2:
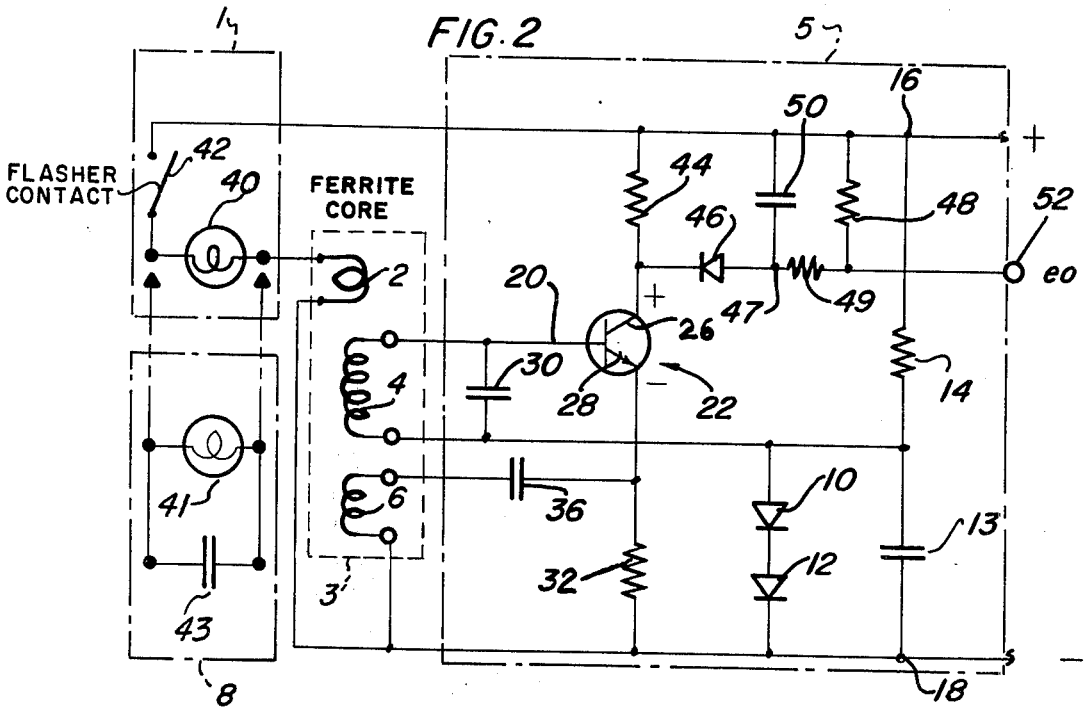
FIG. 2 is an electrical schematic diagram of an oscillator circuit which produces a pulse output when a burned out lamp is sensed.
Figure 3:
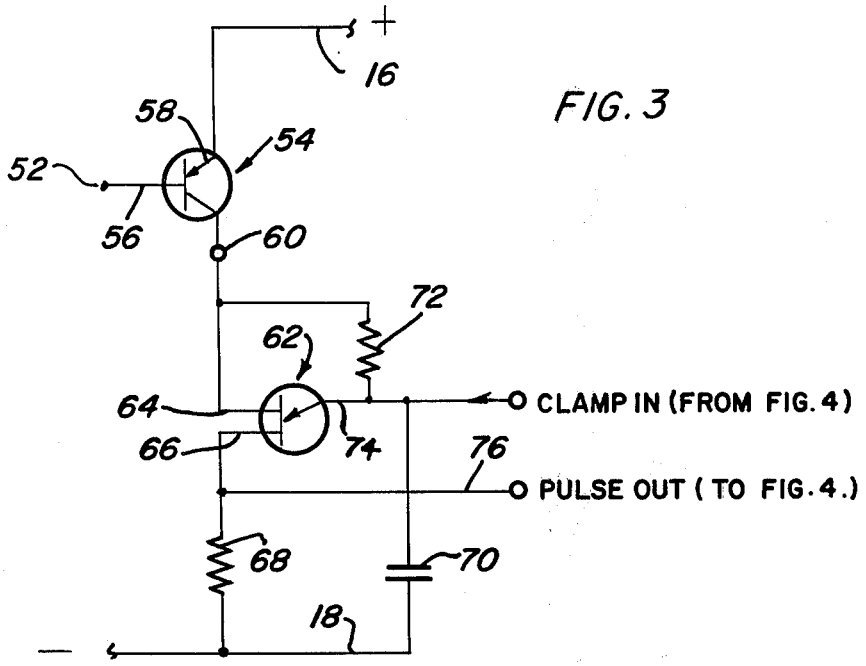
FIG. 3 is an electrical schematic diagram of a circuit that is connected to FIG. 1 and serves as a time delay to prevent the lamp changer mechanism to become activated erroneously, in response to transients.
Figure 4:
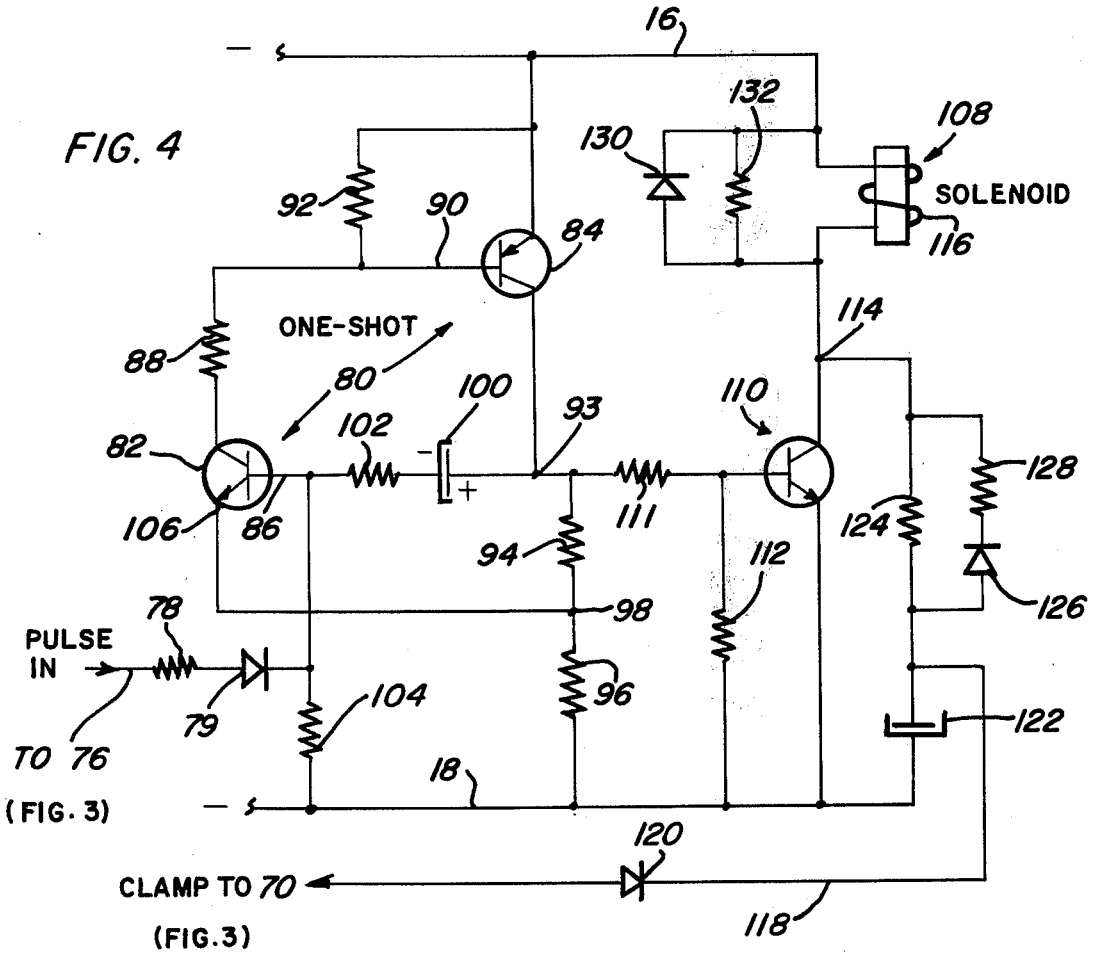
FIG. 4 is an electrical schematic diagram of a circuit portion which is connected to the circuitry of FIGS. 1 and 2. This figure illustrates an amplifier circuit which provides the driving current to a solenoid that activates the mechanism of a lamp changer.

FIGS. 2, 3 and 4 illustrate portions of the block diagram, shown in FIG. 1.

FIG. 2 illustrates an oscillator circuit which essentially includes the components of FIG. 1, previously indicated by reference numerals 1–6. Diodes 10 and 12 are connected in series and provide a forward biased path, through the load resistor 14, between the positive potential 16 and the negative potential 18. Typically, the resistor 14 is 68 k ohms and establishes a voltage typically 1.3 volts. An NPN transistor 22 is provided as the heart of a tuned oscillator. The transistor includes a base terminal 20 which is connected to the junction point between resistor 14 and diodes 10, 12, via the second winding 4 capacitor 13 is connected between the just mentioned junction point. A capacitor 30 is connected across the secondary winding 4 to create a time constant for the input to a transistor 22. During these conditions, the emitter of transistor 22 will be approximately at the same voltage as the voltage drop across diode 12, the drop across the base-emitter junction of transistor 22 being approximately equal to the voltage across diode 10.

Resistor 32 is connected between the emitter of transistor 22 and the negative potential 18. With this resistor being typically 15k ohms, an emitter current through the transistor will be approximately 40 microamps which will be relatively independent of temperature. As will be noted, this current presents a small current drain upon the power source for the system, which would be the lamp changer battery (not shown). Coil 6, is connected in series with capacitor 36 between the emitter 28 of transistor 22 and the negative potential 18. The winding 4 and the capacitor 36 provides positive feedback from the output of transistor 22 to the input thereof, by inductive coupling through winding 4. This positive feedback causes oscillator 22 to oscillate in the event current does not flow through the first winding 2. However, if a lamp current flows through winding 2, as would be the case of a normally operating lamp 40 — flasher contact 42 or, if winding 2 looks into a short circuit or low impedance, then the value of positive feedback will be reduced to the point where oscillation ceases. The strength of the positive feedback is controlled primarily by the value of capacitor 36. The value of this capacitor is dependent upon the inductive coupling between the three windings 4, 6, and 2; the minimum value of lamp current; lamp circuit impedance; lamp variations; and peak currents flowing through the capacitor.

If transistor 22 is unable to oscillate, the current through collector 26, set by resistor 32, will flow through resistor 44, which is identical to resistor 32. Typically, the voltage drop across resistor 44 is in the order of 0.7 volts. Diode 46 has its cathode connected to the collector 26 of transistor 22. The anode terminal of diode 46 is then connected to a junction 47 that has the lower end of capacitor 50 and the end of resistor 49 connected thereto. The presence of diode 46 prevents the flow of current from the collector of transistor 22 to the (FIG. 3) base 56 of transistor 54. The base connection 52 of transistor 54 is completed with resistor 48 connected between the positive potential point 16 and the base terminal 56.

Diode 46 is usually in a condition whereby it is on the verge of conduction and no output voltage ($e_o$)appears at the terminal 52. If the impedance seen by winding 38 is sufficiently high, transistor 22 will oscillate and diode 46 will develop a voltage across capacitor 50, equal to the negative peak value developed across resistor 44.

In FIG. 3, transistor 54 is connected as a switch. As capacitor 50 charges, due to the presence of an output voltage at base terminal 52, there comes a point when the voltage at the base terminal 52 reaches sufficient magnitude to switch transistor 54 to conduction thereby raising point 60 to a positive potential. The threshold voltage necessary to cause transistor 54 to conduct is determined by the ratio of resistors 48 and 49. The transistor 54 is a PNP type and evidences current flow from the emitter 58 to the collector terminate at point 60.

With continued reference to FIG. 3, a unijunction transistor 62 is provided as a pulse generator. This transistor develops a positive pulse across resistor 68 which is connected between the drain terminal 66 and the negative potential 18. This positive pulse will only occur if the collector 60 of transistor 54 (source 64 of unijunction 62) remains positive for at least the time required to charge capacitor 70, which is connected between the gate terminal 74 of unijunction 62 and the negative potential 18. The current flow for charging capacitor 70 includes resistor 72 which is connected between collector 60 of transistor 54 and gate 74 of unijunction 62. Of course, gate 74 must be raised to the firing potential of the unijunction. Thus, the unijunction acts as an initial delay circuit which requires the oscillator circuit to operate for a predetermined delay period, typically, 100 milliseconds, and thus prevents transients from producing an output pulse.

If unijunction 62 succeeds in firing, a pulse output appears at drain 66, terminal 76 and is conducted, (FIG. 4) via resistor 78 and series connected diode 79 to the base terminal 86 of a fourth transistor 82 which cooperates with a fifth transistor 84 to form a monostable multivibrator (one-shot). The diode 79 ensures unidirectional current flow between the gate 74 of unijuntion 62 and transistor 82. The resistor 78 limits the current passing through diode 79. The one-shot 80 includes the connection between the collector of transistor 82 to the base 90 of transistor 84, via a coupling resistor 88. The transistor 84 is biased by connecting a resistor 92 between the positive potential 16 and the base terminal 90.

The two transistors constituting the one-shot are initially non-conducting. However, the pulse from unijunction 62 causes transistor 82 to conduct, which in turn, turns on transistor 84 to conduct strongly and raise the collector terminal or point 93 to a positive line voltage. Due to the connection of a resistor 94 between point 93 and point 98, the latter mentioned point will rise to only a fraction of line voltage. Resistor 96 connects point 98 to the negative potential line 18. Capacitor 100, connected in series with current limiting resistor 102 now provides supply base current to the connected base terminal 86, while resistor 104 provides turn-off bias current, since the emitter 106 of transistor 82 is held positive by the voltage at point 98. The values of 100, 102, and 104 set the time period of the circuit, which can be optimized for the characteristics of the lamp changer solenoid 108 which actuates the lamp changer mechanism (not a part of the present invention). Typically, a value for this time period is 50 milliseconds.

A final transistor stage is shown in FIG. 4 as an output amplifier including transistor 110. This transistor is provided with base current determined by the base resistor 111. The base of the NPN transistor 110 is biased by resistor 112, which is connected between the base terminal and the negative potential 18. The collector 114 is connected in circuit with the solenoid winding 116. When the amplifier 110 conducts strongly, the collector 114 approaches the negative potential 18 thus causing sufficient energizing current to flow through the winding 116 of solenoid 108. A diode 130 and resistor 132 are connected in parallel with the solenoid winding 116. This is for the purpose of protecting the transistor 110 against kickback voltage generated during de-energization of the winding 116. In essence, the components connected across the winding dissipate energy during de-energization of winding 116.

Additional flexibility is provided in the circuit by components 120, 122, and the resistor 124 connected in parallel with the series connected resistor 128 and diode 126. When collector 114 of transistor 110 approaches the negative potential 18, diode 126 and resistor 128 will quickly discharge capacitor 122 and hold it at the negative potential until transistor 110 releases. A first end of capacitor 122 is connected to the anode of diode 126, which forms a junction between the capacitor 122, diode 126 and resistor 124. The opposite end of capacitor 122 is connected to the negative potential 18. When transistor 110 releases, capacitor 122 then recharges, rather slowly, through resistor 124, diode 126, and resistor 128. Due to the fact that the positive terminal of capacitor 122 is clamped to the capacitor 70 in FIG. 3, this latter mentioned capacitor will recharge more slowly after the first firing of unijunction 62. The net result of this is that the initial delay of the unijunction 62 is set by resistor 72 and capacitor 70 as previously discussed. However, subsequently, this delay time is lengthened by the interconnection of capacitor 122 to the capacitor 70. This additional time delay allows for physical movement of the lamp-changer mechanism before an entirely new cycle of continuity testing for a newly positioned lamp is effected.

Capacitor 43 connected across lamp 41 prevents the changer from rotating past the position of lamp 41. Capacity of capacitor 43 is chosen to sufficiently load the coupling coil 2 and prevent oscillations in the LC circuit of L 4 and C 30. In this way the changer is prevented from cycling continuously after failure of the last lamp 41, providing a further reduction on battery power consumption.

It should be understood that the invention is not limited to the exact details of construction shown and described herein for obvious modifications will occur to persons skilled in the art.

Wherefore, I claim the following:

1. A circuit for detecting inoperative lamps in an automatic lamp changer having a lamp change actuator for replacing said lamps with stored operative lamps, the circuit comprising:

a flashing lamp;

ocsillator means inductively coupled to the flashing lamp for generating an output signal when the lamp becomes inoperative; and means for delaying the transmission of the output signal to said lamp change actuator until an output signal of predetermined duration occurs, thus precluding erroneous actuation due to transients.

2. The subject matter of claim 1 together with second delaying means connected to the first-mentioned delaying means for increasing the delay of the transmitted signal after the lamp change actuator has been activated, to prevent further detection of lamp operability until after the lamp changer has had time to change a burned out lamp.

3. In an automatic lamp changer having a lamp change actuator for replacing inoperative lamps with stored operative lamps, a lamp out detection circuit comprising:

an oscillator having an inductance coupled positive feedback loop;

inductive means connected to a flashing lamp and inductively coupled to the feedback loop for suppressing oscillations of the oscillator when the lamp is inoperative; and means connected between the output of the oscillator and said lamp change actuator for delaying transmission of a first oscillator pulse to said lamp change actuator until oscillations of a preselected duration occur, thus preventing erroneous activation of the actuator by transients.

4. The subject matter of claim 3 wherein the delaying means comprises:

switch means connected to the output of the oscillator for conducting when oscillations occur; and means connected to the output of the switch means for generating a pulse at a predetermined time after the switch means continues conducting.

5. The subject matter of claim 4 together with charging means connected in circuit with the lamp change actuator for delaying pulses subsequent to said first pulse from the pulse generating means for a predetermined interval sufficient to allow the actuator to change bulbs before a new detection cycle begins.

6. The subject matter of claim 4 together with means triggered by the output of the pulse generating means for generating a drive signal of sufficient duration to permit energization of the actuator for a period sufficient to allow a lamp to be changed.

7. The subject matter of claim 6 together with amplifier means connected between the drive signal generating means and the actuator for conducting sufficient current through the actuator to properly energize the actuator.

8. The subject matter of claim 3 wherein the oscillator comprises:

a transistor having collector, base and emitter electrodes;

parallel connected LC components connected in circuit with the base electrode to form a tuned oscillator input;

the inductance coupled positive feedback loop including inductive means connected to the emitter of the transistor; and further wherein the means connected to the flashing lamp and inductively coupled to the feedback loop comprises a winding mounted on a ferrite core with the L component and the inductive means connected to the emitter.

9. The circuitry defined in claim 4 wherein the pulse generating means comprises a unijunction transistor having source, drain and gate electrodes;

means connecting the source electrode to the output of the switch means, to provide triggering of the unijunction transistor;

means connected to the drain electrode for providing a pulse output for the unijunction; and first capacitor means connected to the gate electrode for charging to a unijunction firing voltage after a preselected delay interval.

10. The subject matter of claim 9 together with second capacitor means connected between the first capacitor means and the lamp change actuator for increasing a subsequent delay interval, necessary to fire the unijunction, to a duration sufficient to change a lamp.

11. In an automatic lamp changer, having a lamp change actuator, a flashing lamp, a lamp turret carrying multiple lamps for rotation into operating position by the actuator, a lamp out detection circuit comprising:

an oscillator having an inductance coupled positive feedback loop;

inductive means connected to a said flashing lamp and inductively coupled to the feedback loop for suppressing oscillations of the oscillator when said flashing lamp is operating, and conversely, permitting oscillation of the oscillator when the lamp is inoperative; and means connected between the output of the oscillator and said lamp change actuator for delaying transmission of oscillator pulses to said lamp change actuator until oscillation of a preselected duration occur; and capacitor means connected in parallel with a selected lamp on said turret in order to prevent rotation of the turret beyond said selected lamp.

* * * * *